US006645098B1

(12) United States Patent
Quinn

(10) Patent No.: US 6,645,098 B1
(45) Date of Patent: Nov. 11, 2003

(54) STREET HOCKEY BALL

(75) Inventor: Charles T. Quinn, Dover, MA (US)

(73) Assignee: Franklin Sports, Inc., Stoughton, MA (US)

( * ) Notice: Subject to any disclaimer, the term of this patent is extended or adjusted under 35 U.S.C. 154(b) by 0 days.

(21) Appl. No.: 10/152,698

(22) Filed: May 22, 2002

(51) Int. Cl.[7] ..... A63B 39/00
(52) U.S. Cl. ..... 473/594; 473/595
(58) Field of Search ..... 473/594, 595, 473/588, 596, 577

(56) References Cited

U.S. PATENT DOCUMENTS

| | | | | |
|---|---|---|---|---|
| 1,991,671 A | | 2/1935 | Hodson | |
| 2,670,206 A | | 2/1954 | Brewster | |
| 3,734,498 A | | 5/1973 | Seiersen | |
| 4,119,315 A | | 10/1978 | Goldfarb | |
| 4,244,855 A | | 1/1981 | Cox et al. | |
| 4,448,418 A | | 5/1984 | McNeill | |
| 4,872,676 A | | 10/1989 | Townsend | |
| 5,149,096 A | | 9/1992 | Keating | |
| 5,516,098 A | | 5/1996 | Aiello | |
| 5,647,809 A | * | 7/1997 | Yip | 473/594 |
| 5,722,906 A | | 3/1998 | Gentile | |
| 6,322,465 B1 | * | 11/2001 | Gentile | 473/594 |

* cited by examiner

*Primary Examiner*—Steven Wong
(74) *Attorney, Agent, or Firm*—Shook Hardy & Bacon

(57) ABSTRACT

A ball for use in playing street hockey having a substantially smooth spherical shell with a hollow interior cavity partially filled with a liquid and a plurality of prills to less than one-half of the volume of the interior cavity. The specific gravity of the prills is less than that of the liquid to minimize splash of the liquid and to improve the ability of the liquid to remain in the lower portion of the ball as it travels over a playing surface.

8 Claims, 1 Drawing Sheet

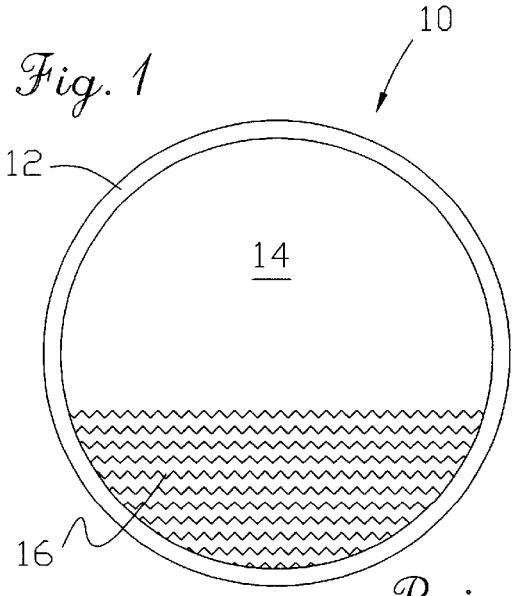
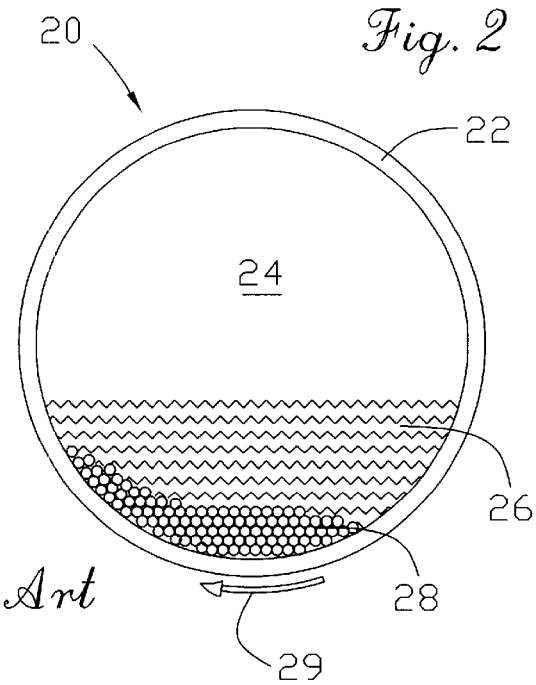
Prior Art
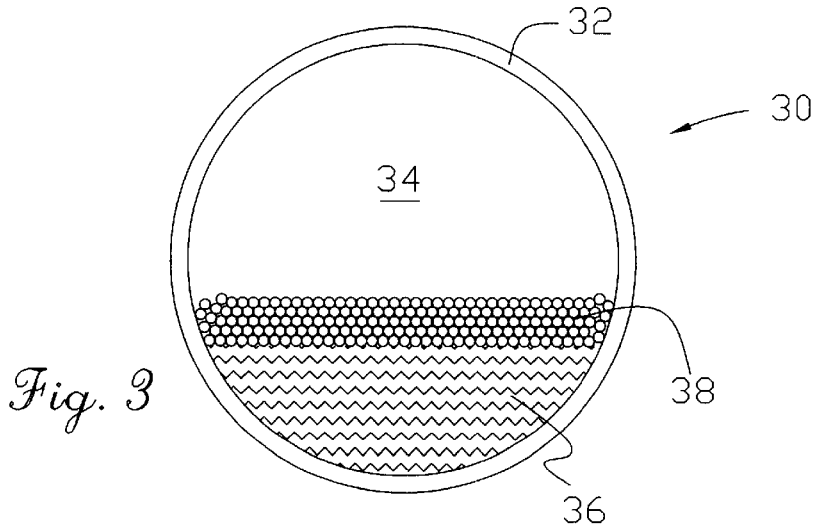
Fig. 3

STREET HOCKEY BALL

BACKGROUND OF THE INVENTION

This invention relates to a ball for use in street hockey play. More specifically, this invention relates to an improved street or field hockey ball having superior dampening characteristics to cause the ball to roll rather than bounce on the playing surface.

The sport of street hockey has gained widespread popularity as children and adults alike search for new and interesting ways to stay active and compete against their peers. Many reasons account for the increasing number, of participants. Street hockey can be played outside during warm weather or cold. Ice hockey, of course, may be played outdoors only when the temperature is sufficiently cold. Moreover, compared to ice hockey, the sport of street hockey is inexpensive to play, yet provides a similar level of competition. In addition, while ice hockey requires a substantial investment in equipment and costly ice time, street hockey requires little more than a hockey stick, level ground on which to play, and a ball or other object that simulates the ice hockey puck.

Several products are commercially available to simulate a puck. The products most similar to the present invention include solid balls made of a hard substance such as rubber or plastic, and hollow balls partially filled with liquid, solid particles or a combination of both. The solid balls are resilient, but their tendency to bounce reduces their effectiveness as hockey puck substitutes. The hollow balls partially filled with liquid or solids reduce the ball=s tendency to bounce somewhat by lowering the ball=s center of gravity. They do not, however, totally eliminate bounce because the liquid or solids filling material does not stay in the lower half of the ball as the ball rolls. This characteristic tends to impart an erratic or jerky motion to the rolling ball. Moreover, the liquid or solids tend to splash or disperse when the ball is struck by the hockey stick and each time the ball bounces which can contribute to erratic motion.

The tendency of bounce and erratic motion reduces the effectiveness of commercially-available products. Accordingly, a need remains in the sporting goods industry for a street hockey ball having minimal bounce and uniform rolling characteristics. The primary objective of this invention is to meet this need.

SUMMARY OF THE INVENTION

More specifically, an object of the invention is to provide a street hockey ball of durable and quality construction having a steady and uniform rolling motion when struck to travel over a level playing surface.

Another object of the invention is to provide a street hockey ball having a reduced tendency to bounce when struck to travel over a level playing surface.

A further object of the invention is to provide a street hockey ball of the character described partially filled with a liquid to maintain a low center of gravity for the ball as an aid in reducing the tendency to bounce.

Yet another object of the invention is to provide a street hockey ball of the character described partially filled with a liquid to maintain a low center of gravity for the ball as an aid in reducing the tendency to bounce and a layer of floating solids to minimize splash of the liquid and to improve the ability of the liquid to remain in the lower portion of the ball as it travels over a playing surface.

In summary, a ball for use in playing street hockey having a substantially smooth spherical shell with a hollow interior cavity partially filled with a liquid and a plurality of prills to less than one-half of the volume of the interior cavity. The specific gravity of the prills is less than that of the liquid to minimize splash of the liquid and to improve the ability of the liquid to remain in the lower portion of the ball as it travels over a playing surface.

Other and further objects of the invention, together with the features of novelty appurtenant thereto, will appear in the course of the following description of the drawings.

BRIEF DESCRIPTION OF THE DRAWINGS

In the accompanying drawings, in which like reference numerals are employed to indicate like parts in the various views:

FIG. 1 is a cross-sectional view of a prior art street hockey ball partially filled with a liquid, FIG. 2 is a cross-sectional view of another prior art street hockey ball partially filled with liquid and solid particles; and FIG. 3 is a cross-sectional view of a street hockey ball constructed in accordance with a preferred embodiment of the invention.

DETAILED DESCRIPTION OF THE DRAWINGS

Referring to the drawing in greater detail, FIGS. 1 & 2 show examples of prior art street hockey balls. Prior art ball 10 includes a spherical outer shell 12 having a hollow interior cavity 14 partially filled with a free flowing liquid 16. The liquid 16 lowers the center of gravity of the ball 10 and imparts some dampening effect to the natural tendency of the ball to bounce when struck to travel over a level playing surface (not shown). Commercially available products as shown in FIG. 1 typically provide a non-toxic antifreeze as the liquid 16 to permit play during winter conditions.

Prior art ball 20 in FIG. 2 includes a spherical outer shell 22 having a hollow interior cavity 24 partially filled with a free flowing liquid 26 and solid particles 28. Some prior art balls use only solids 28. The liquid 26 and solids 28 (or solids alone) lower the center of gravity of the ball 10 and impart an improved dampening effect to the natural tendency of the ball to bounce when struck to travel over a level playing surface (not shown). Introduction of solids 28 such as sand or small, dense beads to the interior cavity 24 of a prior art ball 20, either alone or in combination with a liquid 26, results in a tradeoff between desirable and undesirable characteristics. Due to the weight of the solids 28, there is a better lowering of the center of gravity of the ball 20 which improves dampening of the ball, but motion of the ball 20 can become more erratic. It is believed that the erratic motion is caused by centripetal force on the solids as the ball rotates and by the tendency of the solids to Acling≅ to the trailing side of the ball 20 during travel across a playing surface. An attempt to illustrate this phenomena is shown in FIG. 2. Rotation of the shell 22 in the direction of arrow 29 would result in the solids 28 being displaced to the left of the view in FIG. 2 as the ball 20 itself moves across the playing surface to the right in the same view.

A street hockey ball 30 constructed in accordance with a preferred embodiment of the invention is illustrated in FIG. 3. The ball 30 includes a spherical outer shell 32 constructed of a durable, bounce-resistant material such as high impact plastic. The shell 22 has a hollow interior cavity 34 partially filled with a liquid 36 and a plurality of light weight prills 38 which float as a layer on the surface of the liquid 36.

In the preferred embodiment, the liquid 36 is a salt water solution, such as calcium chloride dissolved in water. Such a solution has good viscosity characteristics and also permits use of the ball 30 during a wide range of ambient conditions. However, any free flowing liquid may be used which is nonreactive with the material from which the shell 22 is fabricated.

The prills 38 are preferably of a spherical shape and uniform in size. Expandable polystyrene is an acceptable material of construction for the prills 38. Nonetheless, various shapes, sizes and compositional materials may be utilized without departing from the scope of the invention. It is of critical importance, however, that the prills 38 have a substantially uniform density and have a specific gravity less than the specific gravity of the liquid 36. It is also important that the prills 38 not react chemically with the liquid 36. Accordingly, once the chemical and physical properties are determined by selection of a liquid 36, then the correspondingly appropriate compositional materials available for use as the prills 38 can be determined.

In operation, the combination of the liquid 36 and solid prills 38 provide a street hockey ball 30 with a greatly reduced tendency to bounce as compared to other commercially-available balls, while at the same time providing a consistently uniform motion when traveling across a playing surface. When struck by a hockey stick or when striking the playing surface, the liquid 36 contained within the shell 32 quickly settles to the bottom of the interior cavity 34, thereby lowering the center of gravity of the ball 30. The prills 38 reduce the splashing or dispersing of the liquid 36 and reduce the length of time it takes for the liquid 36 to settle to the bottom of the interior cavity 34, without imparting erratic ball motion characteristic of prior art balls.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

NUMERALS prior art street hockey ball 10
outer shell 12
interior cavity 14
liquid 16
prior art street hockey ball 20
outer shell 22
interior cavity 24
liquid 26
particles 28
direction arrow 29
street hockey ball 30
outer shell 32
interior cavity 34
liquid 36
particles 38

Having thus described my invention, I claim:

1. A ball for use in playing street hockey, said ball comprising:

a uniformly rollable, rigid spherical exterior shell with a hollow interior cavity;

a free flowing liquid partially filling said interior cavity; and a plurality of uniform, solid prills floating in said liquid, said prills having a uniform density and a specific gravity less than said liquid.

2. The ball as in claim 1, wherein said liquid and said prills combined occupy less than one-half of the volume of said cavity.

3. The ball as in claim 1, said liquid being chemically nonreactive with said exterior shell.

4. The ball as in claim 3, said liquid comprising a salt water solution.

5. The ball as in claim 4, said liquid comprising calcium chloride dissolved in water.

6. The ball as in claim 1, said prills being generally spherical in shape and uniform in size.

7. The ball as in claim 6, said prills being chemically nonreactive with said liquid.

8. The ball as in claim 7, said prills being fabricated of expandable polystyrene.

* * * * *